US006669032B2

(12) United States Patent
Kao

(10) Patent No.: US 6,669,032 B2
(45) Date of Patent: Dec. 30, 2003

(54) TOOL SUSPENSION RACK

(76) Inventor: Jui-Chien Kao, No. 358, Tunghsing Rd., Tali City, Taichung Hsien (TW)

( * ) Notice: Subject to any disclaimer, the term of this patent is extended or adjusted under 35 U.S.C. 154(b) by 0 days.

(21) Appl. No.: 10/340,603

(22) Filed: Jan. 13, 2003

(65) Prior Publication Data

US 2003/0102275 A1 Jun. 5, 2003

Related U.S. Application Data

(62) Division of application No. 09/975,990, filed on Oct. 15, 2001.

(51) Int. Cl.[7] ..... A47F 7/00
(52) U.S. Cl. ..... 211/70.6; 206/378
(58) Field of Search ..... 211/70.6; 206/378, 206/493, 806, 372, 376

(56) References Cited

U.S. PATENT DOCUMENTS

| | | | | | |
|---|---|---|---|---|---|
| 5,740,911 | A | * | 4/1998 | Chou | 206/378 |
| 5,967,340 | A | * | 10/1999 | Kao | 211/70.6 |
| 5,975,297 | A | * | 11/1999 | Kao | 206/378 |
| 6,092,656 | A | * | 7/2000 | Ernst | 206/378 |
| 6,113,867 | A | * | 9/2000 | Mayer | 422/300 |
| 6,415,933 | B1 | * | 7/2002 | Kao | 211/90.6 |
| 6,508,360 | B1 | * | 1/2003 | Chen | 206/378 |

* cited by examiner

*Primary Examiner*—Alvin Chin-Shue
*Assistant Examiner*—Khoa Tran
(74) *Attorney, Agent, or Firm*—Fei-Fei Chao; Venable, LLP

(57) ABSTRACT

A tool suspension rack consists of a suspension element (10, or 50) movably hanging multiple tool sockets (14) thereon, and a fixing element (20, 40, or 80) secured on the suspension plate (10) and meanwhile fixing the multiple tool sockets (14) so as to provide a theft-proof effect.

4 Claims, 11 Drawing Sheets

TOOL SUSPENSION RACK

CROSS-REFERENCE TO RELATED APPLICATION

The present invention is a division application of the co-pending U.S. Ser. No. 09/975,990, filed on Oct. 15, 2001.

BACKGROUND OF THE INVENTION

1. Field of the Invention

The present invention relates to a tool suspension rack, and more particularly a tool suspension rack that retains a set of tool sockets or tool sockets with tool heads thereon and provides a security effect for suspending the tool sockets and sockets with tool heads in a retail store or similar.

2. Description of Related Art

Conventional wrench socket storage has been on the market and in the work place since the advent of wrench sockets. These devices have ranged from a tool box having divisions therein carefully configured to accommodate the graduated size of each socket to hanging devices having extremely sharp spring clip socket retaining devices. These devices have shortcomings and are not convenient for storing the tools.

The storage devices also have to be designed to provide secure yet accessible display in a retail environment. That is, potential customers must be able to see and feel the quality of the sockets in order to buy them with confidence, yet thieves must be prevented from shoplifting the tools. Additionally, the tool suspension rack has to be simplified in its structure so as to be quickly assembled, and reduce product cost.

In order to meet these requirements, the present invention provides a tool suspension rack to conveniently retain a set of tool sockets or tool sockets with tool heads.

SUMMARY OF THE INVENTION

A first objective of the invention is to provide a tool suspension rack that has a theft-proof effect.

A second objective of the invention is to provide a tool suspension rack that makes tool sockets and tool heads hanging on the tool suspension rack easily attached and detached therefrom.

Other objects, advantages and novel features of the invention will become more apparent from the following detailed description when taken in conjunction with the accompanying drawings.

DETAILED DESCRIPTION OF THE PREFERRED EMBODIMENT

Figure 1:
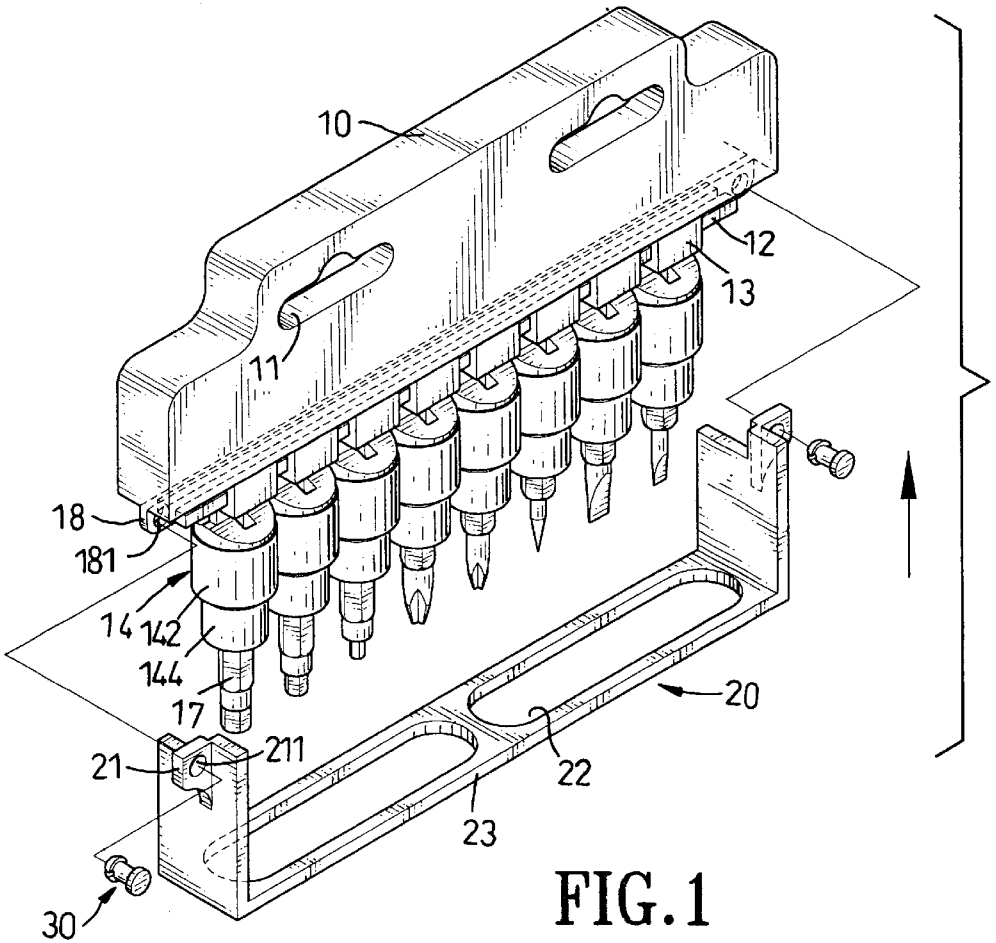
FIG. 1 is an exploded perspective view of a first embodiment of a tool suspension rack in accordance with the present invention.
Figure 2:
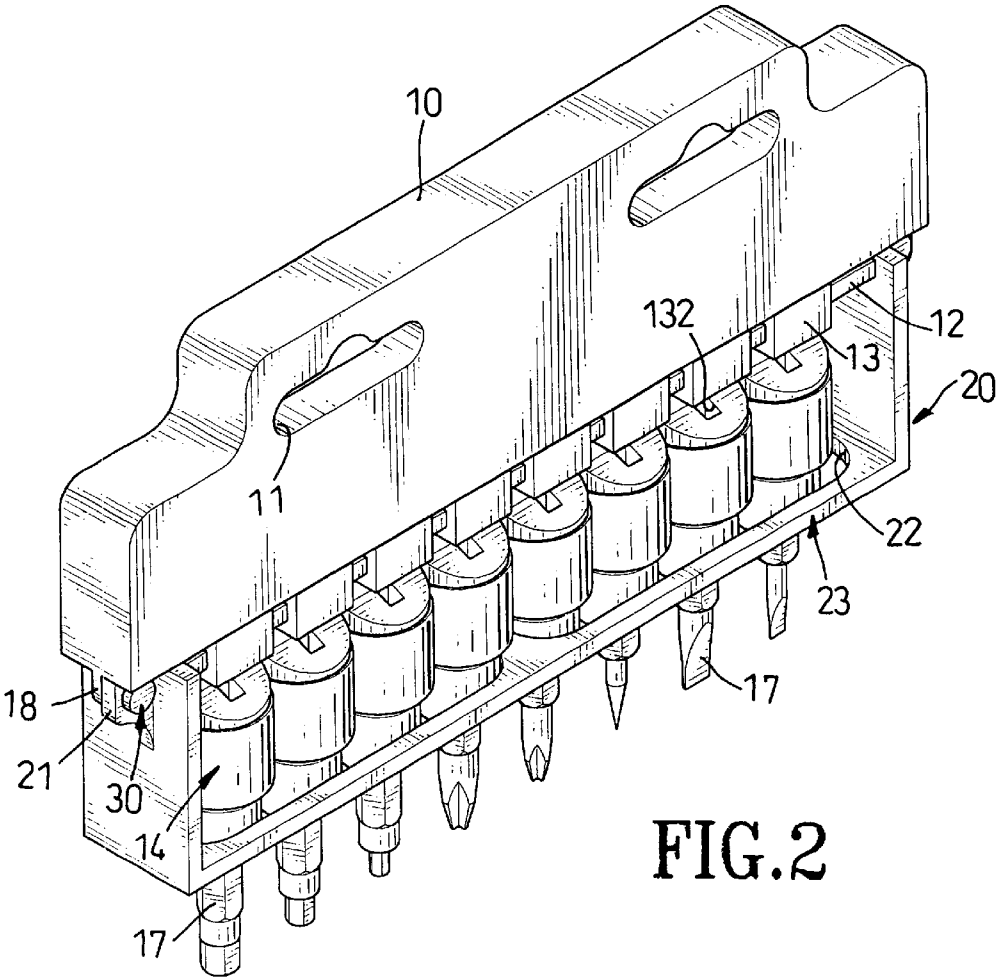
FIG. 2 is a perspective view of the tool suspension rack in accordance with FIG. 1, wherein the tool suspension rack is assembled.

With reference to FIGS. 1, and 2, a tool suspension rack is composed of a suspension plate (10), multiple tool sockets (14) movably attached to the suspension plate (10), and a fixing rack (20) detachably secured on the suspension plate (10) and meanwhile fixing the multiple tool sockets (14).

The suspension plate (10) has at least one suspension hole (11) defined therein to make the tool suspension rack able to be hung on a hook or similar. A track (12) is formed laterally on a bottom face of the suspension plate (10) and has multiple socket connectors (13) that slide on the track (12). Each socket connector (13) detachably connects with a respective one of the tool sockets (14) so that a user is enabled to directly pull out any selected tool socket (14). The tool socket (14) is divided into an upper portion (142) and a lower portion (144) and has a tool head (17) connected with the lower portion (14). Additionally, two flanges (18) are formed on opposite ends of the track (12) respectively and each flange (18) has a first aperture (181) defined therein.

The fixing rack (20) is U-shaped and has two connecting protrusions (21) formed on two oppositely distal ends of the fixing rack (20). Each connecting protrusion (21) has a second aperture (211) corresponding to the first aperture (181) of the track (12). At least one opening (22) is defined in a bottom portion (23) of the U-shaped fixing rack (20).

Now referring to FIG. 2, when the suspension plate (10) is combined with the fixing rack (20), the first aperture (181) of the flange (18) and the second aperture (211) of the connecting protrusion (21) are penetrated and then fixed by a snapper (30). At the same time, the at least one opening (22) is penetrated by the tool heads and the lower portions (144) of the tool socket (14). Therefore, the bottom portion (23) of the fixing rack (20) sleeves and limits the tool sockets (14) so as to avoid the tool sockets (14) detaching from the socket connector (13) when someone wants to steal a single tool socket (14).

Figure 3:
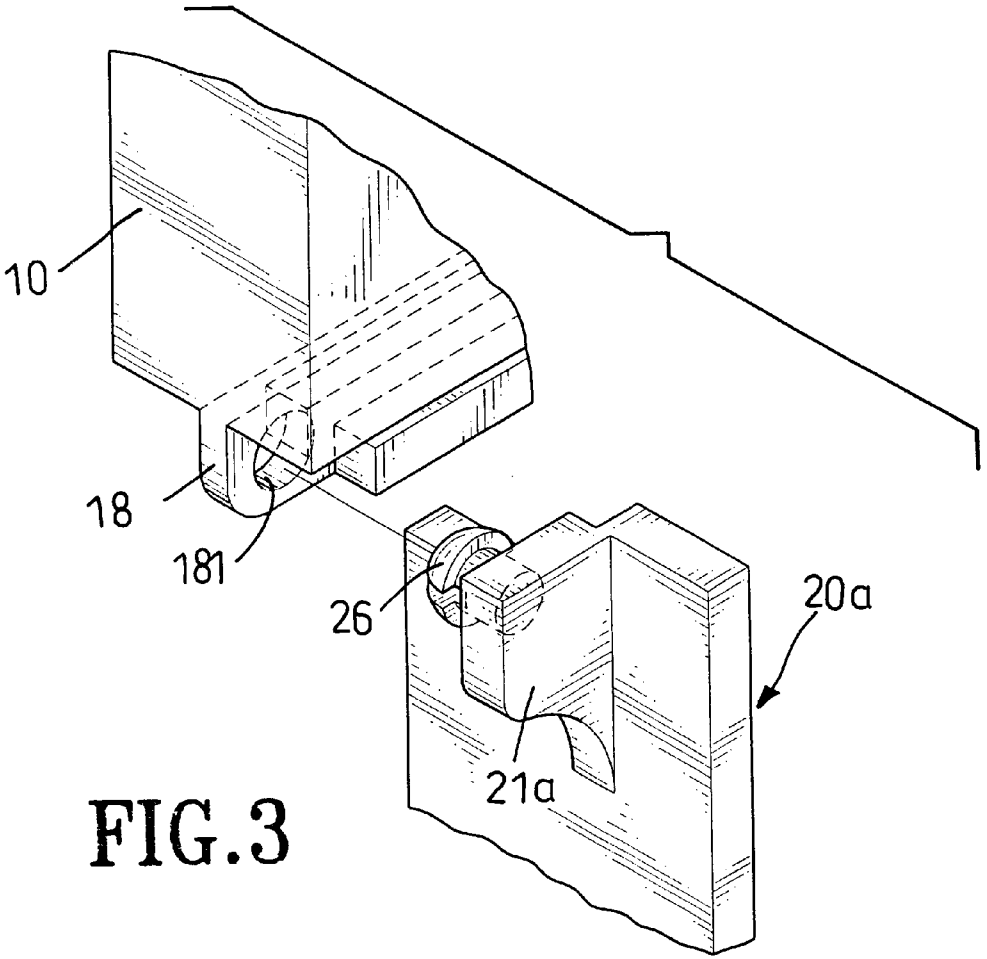
FIG. 3 is a partially perspective view of a connecting device of the tool suspension rack in accordance with FIG. 1.

With reference to FIG. 3, one embodiment of a connecting way for the suspension plate (10) and the fixing rack **(20*a*) is shown, wherein a resilient nub (26) is formed on the connecting protrusion (21*a*) and corresponding to the first aperture (181) of the flange (18). The resilient nub (26) is wedged into the first aperture (181) to connect the suspension plate (10) and the fixing rack (20*a*) so that the fixing rack (20*a*) provide a protection for the tool sockets (14). It is easy to be understood that the connecting way between the suspension plate (10) and the fixing rack (20*a*)** has a variety of choices such as screw-nut or clipping devices . . . etc in application.

Figure 4:
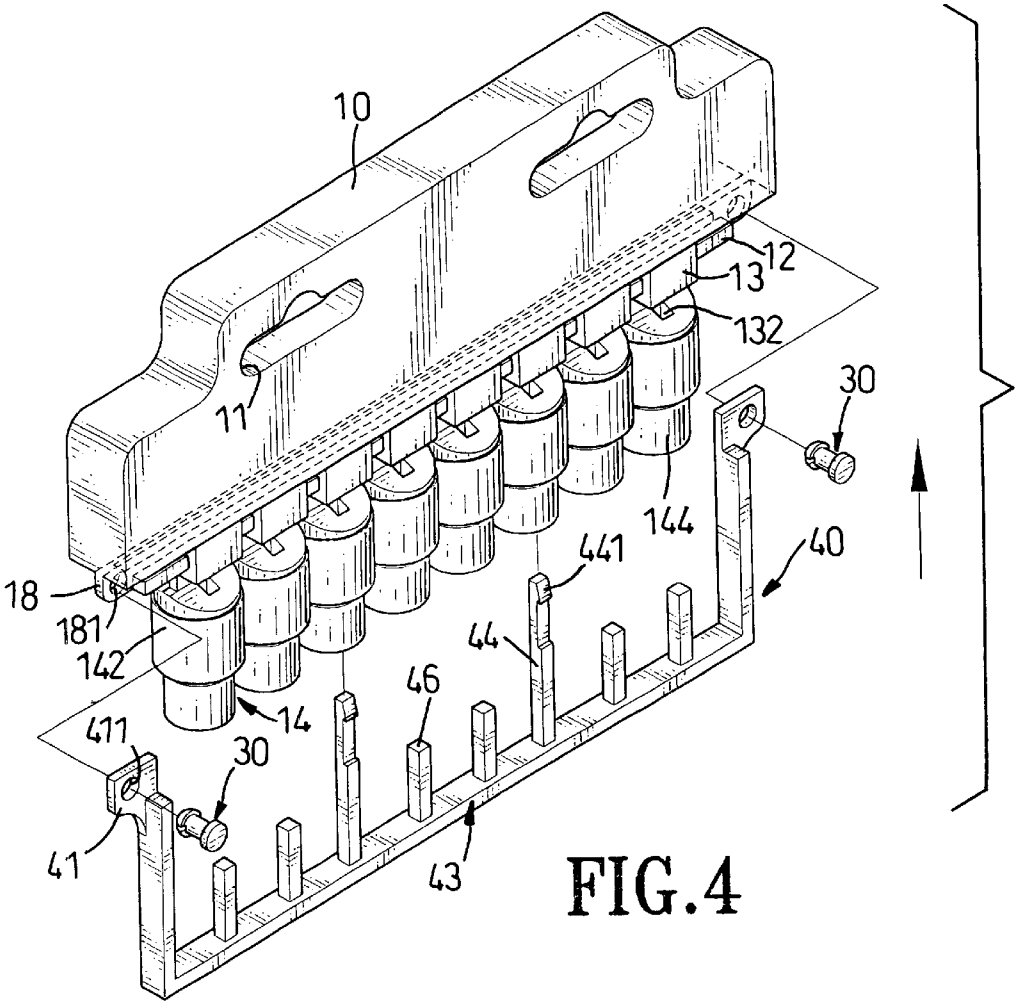
FIG. 4 is an exploded perspective view of a second embodiment of the tool suspension rack, which has multiple insertions.
Figure 5:
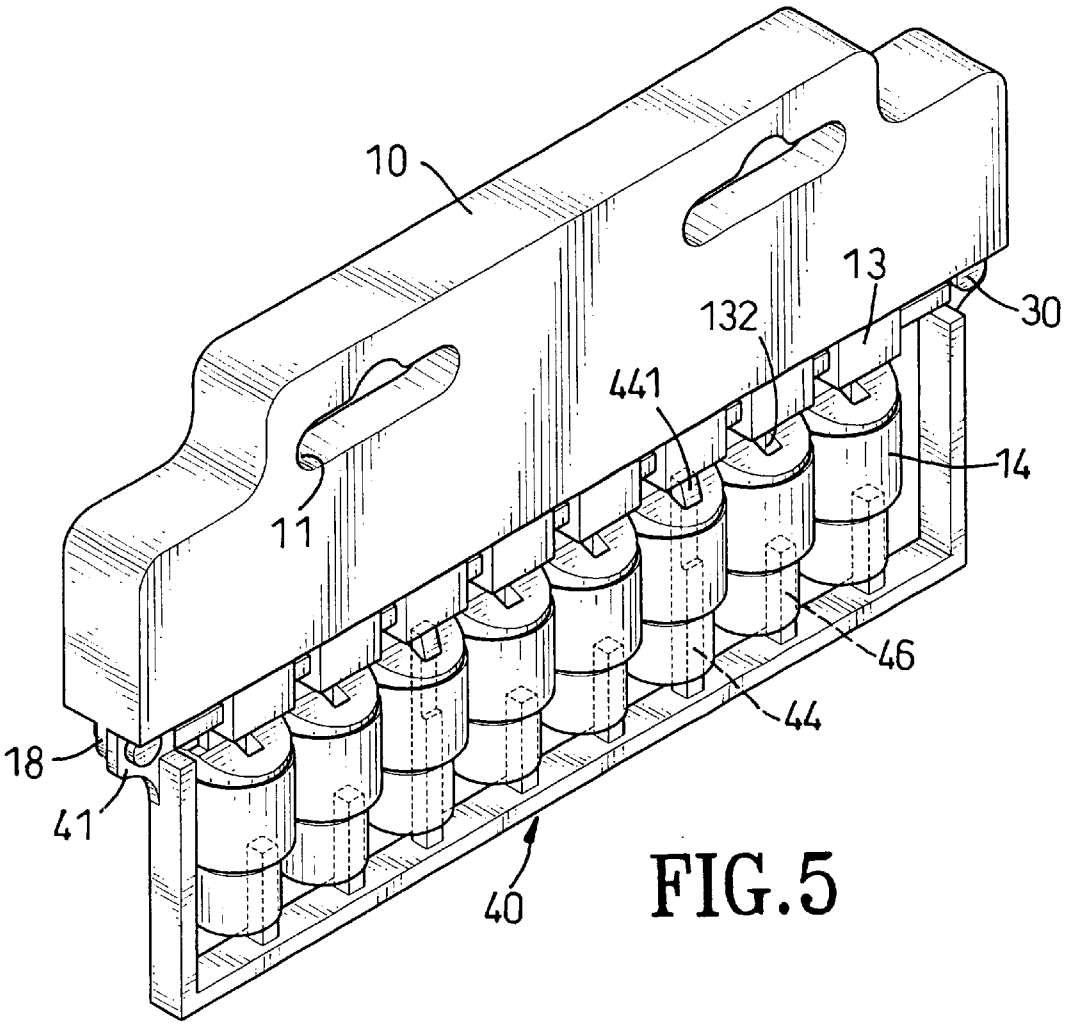
FIG. 5 is a perspective view of the second embodiment of the tool suspension rack in accordance with FIG. 4, wherein the tool suspension rack is assembled.

FIGS. 4 and 5 show a second embodiment of the tool suspension rack which is composed of the suspension plate (10) substantially the same as in FIG. 1 and a fixing grating (40) securable on the suspension plate (10) to provide a theft-proof effect for the tool sockets (14).

The suspension plate (10) is the same as the first embodiment and is not redundantly described here. However, each socket connector (13) has a through hole (132) vertically defined therein and detachably connects with a tool socket (14) so that a user is able to directly pull out any tool socket (14) wanted.

The fixing grating (40) is substantially U-shaped and has two connecting protrusions (41) formed on two oppositely distal ends of the fixing grating (40). Each connecting protrusion (41) has a second aperture (411) corresponding to the first aperture (181) of the track (12). At least one first insertion (44) protrudes from a bottom strip (43) of the fixing grating (40) and each first insertion (44) has a resilient hook (441) formed on a distal end thereof. Additionally, at least one second insertion (46), which is shorter than the first insertion (44), protrudes from the bottom strip (43) and is arranged in a certain sequence with the first insertion (44) on the fixing grating (40).

Now referring to FIG. 5, when the tool suspension rack is in combination, the first aperture (181) of the flange (18) and the second aperture (211) of the connecting protrusion (21) are penetrated and then fixed by a snapper (30). At the same time, the first insertions (44) penetrate the tool sockets (14) and the through hole (132) of the socket connector (13). Thus, the resilient hooks (441) of the first insertions (44) retain the fixing grating (40) on the suspension plate (10) so as to avoid the tool sockets (14) being stolen. Meanwhile, the second insertions (46) extend into hollow portions within the tool sockets (14) that also provide the fixing and a theft-proof effect for the tool sockets (14).

Figure 6:
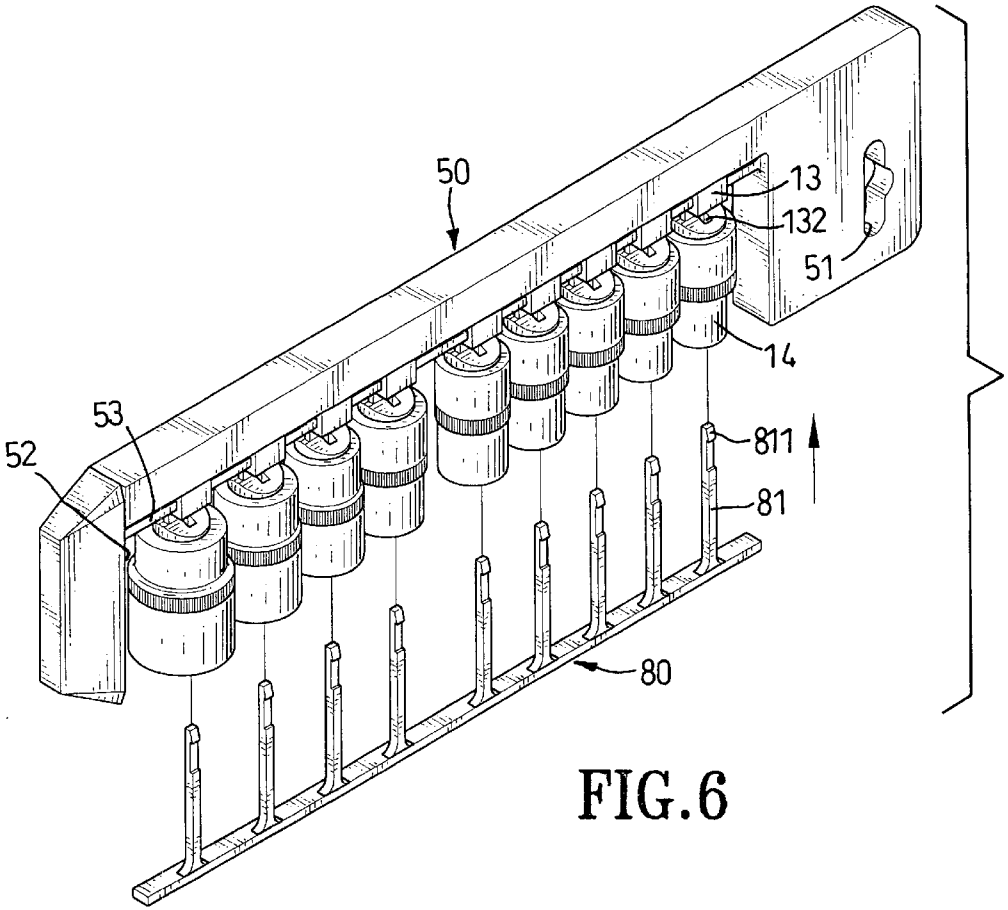
FIG. 6 is an exploded perspective view of a third embodiment of the tool suspension rack.
Figure 7:
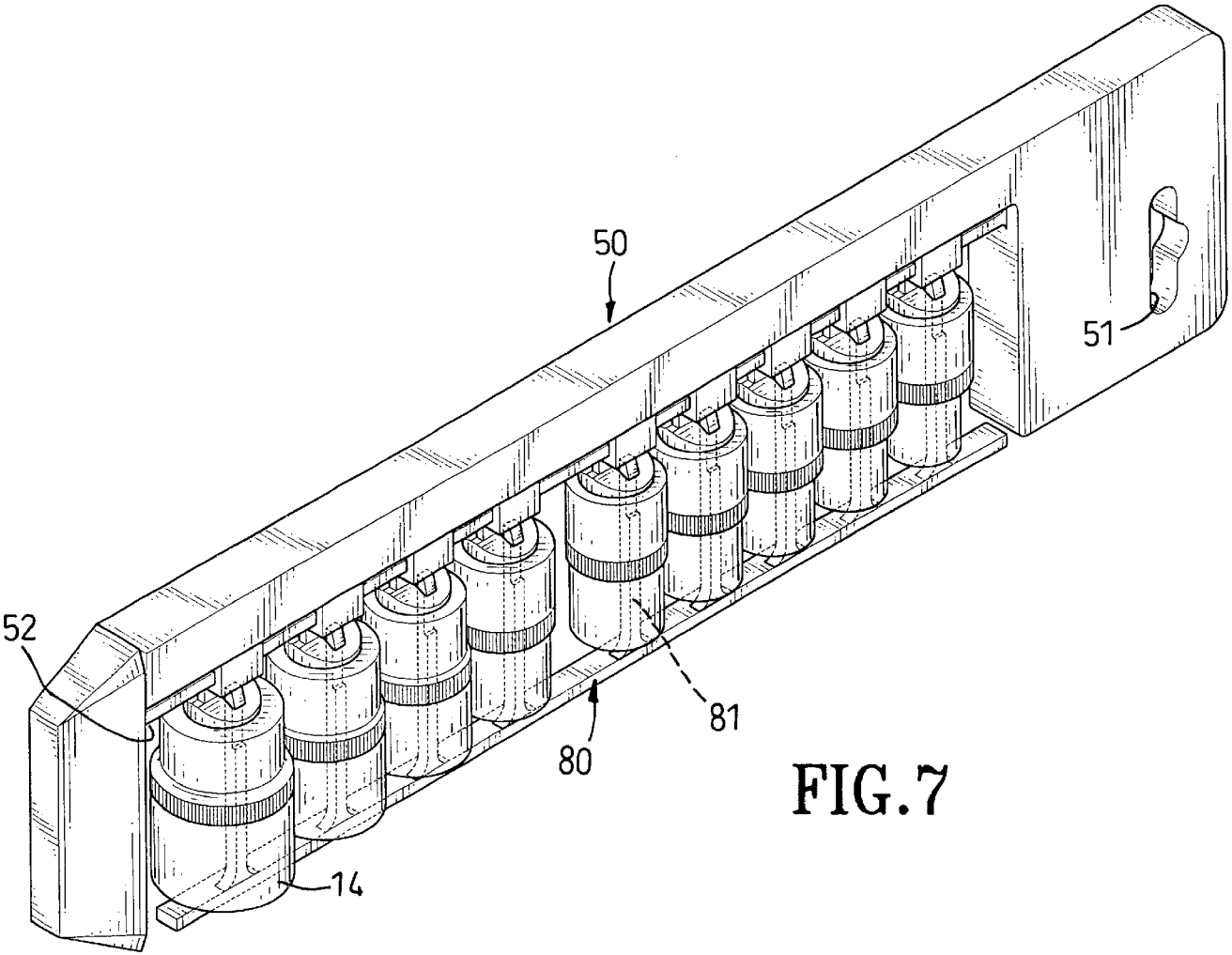
FIG. 7 is a perspective view of the third embodiment of the tool suspension rack in accordance with FIG. 6, wherein the tool suspension rack is assembled.

With reference to FIGS. 6 and 7, a further embodiment of the tool suspension rack is composed of a suspension frame (50) receiving multiple tool sockets (14) inside and a fixing strip (80) connected with the suspension frame (50).

The suspension frame (50) has at least one hole (51) defined therein to make the tool suspension rack able to be hung on a hook or the similar. A recess (52) is defined in the suspension frame and a track (53) is formed laterally on an inner wall of the recess (52), wherein multiple socket connectors (13) slide on the track (53). Each socket connector (13) has the through hole (132) vertically defined therein and detachably connects with the tool socket (14) so that a user is enabled to directly pull out any tool socket (14) wanted. The tool socket (14) is hollow and communicated with the through hole (132) of the socket connector (13).

The fixing strip (80) has multiple first insertions (81) upwardly formed from the fixing strip (80). Each first insertion (81) has a resilient hook (811) formed on a distal end thereof and the resilient hook (811) is wedged through the through hole (132) of the socket connector (13) to provide fixing and theft-proof effects for the tool socket (14).

Figure 8:
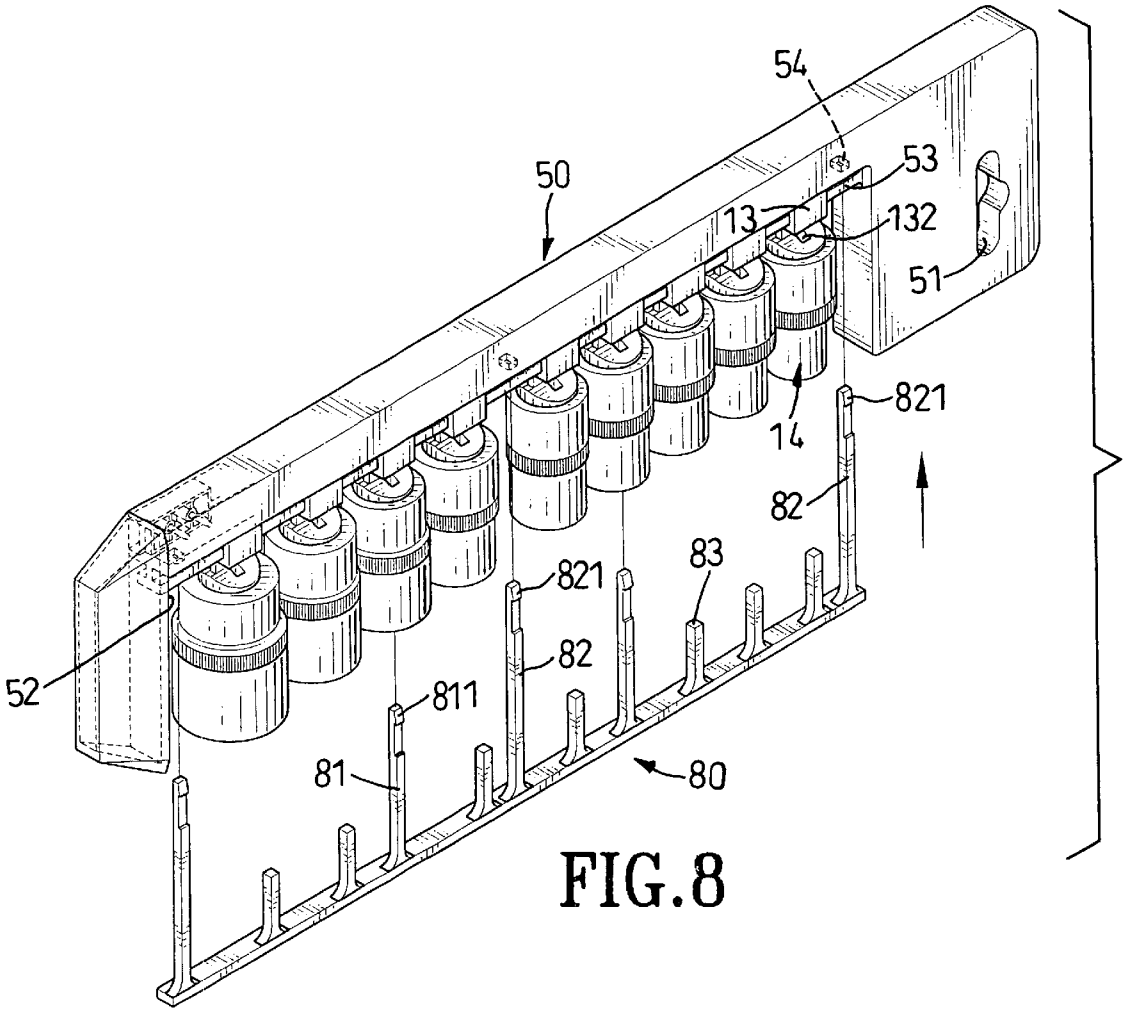
FIG. 8 is an exploded perspective view of a fourth embodiment of the tool suspension rack wherein a fixing strip has various insertions.
Figure 9:
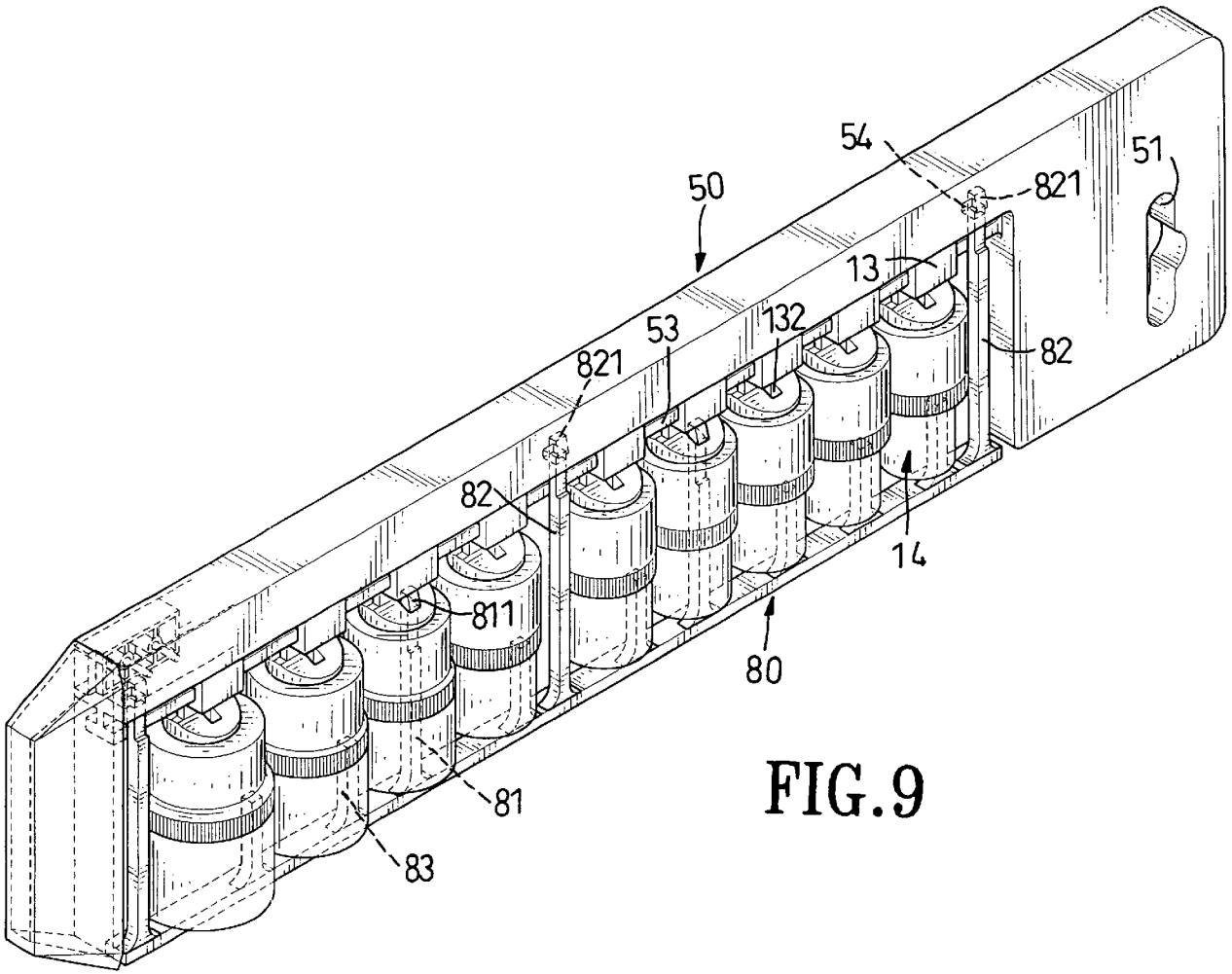
FIG. 9 is a perspective view of the fourth embodiment of the tool suspension rack in accordance with FIG. 8, wherein the tool suspension rack is assembled.
Figure 10:
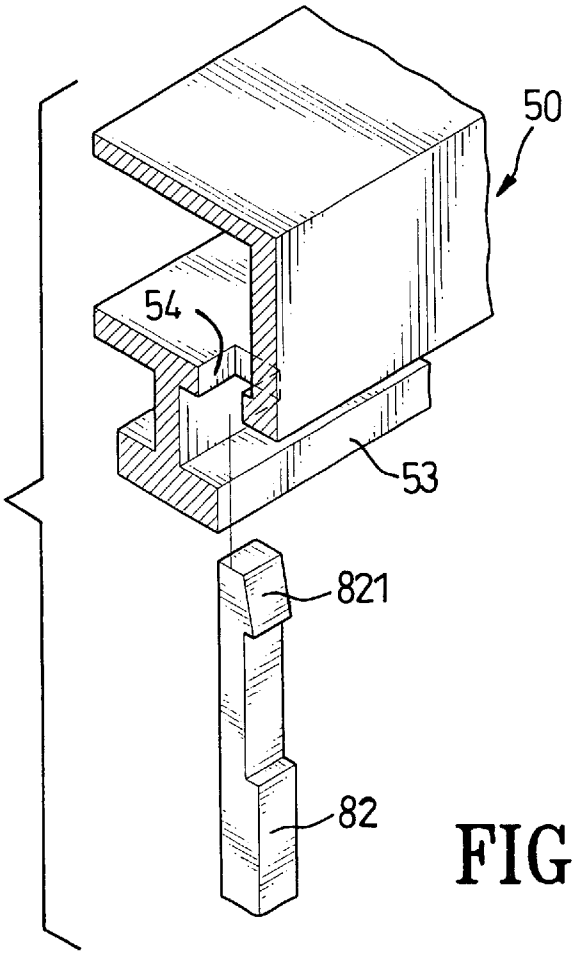
FIG. 10 is a partially enlarged exploded view of a fixing insertion and an insert hole of the tool suspension rack.

With reference to FIGS. 8, 9, and 10, a yet further embodiment of the tool suspension rack is basically the same with the embodiment in FIGS. 6 and 7. The difference of the fourth embodiment in comparison with the third embodiment of the tool suspension rack comprise:

The suspension frame (50) further has at least one insert hole (54) defined in the inner wall where the track (521) exists. The fixing strip (80) further has at least one fixing insertion (82) protruding upwardly from the fixing strip (80) and correspondingly inserting into the insert hole (54) of the suspension frame (50). Each fixing insertion (82) has a resilient hook (821) formed at a distal end thereof to wedge into the insert hole (54) so as to combine the fixing strip (80) to the suspension frame (50) and then provide the theft-proof effect for the tool sockets (14).

Additionally, multiple second insertions (83) shorter than the first insertion (81) protrude upwardly from the fixing strip (80) to fix the tool sockets (14) by inserting into the hollow portion of the tool sockets (14) when the tool suspension rack is in combination.

Figure 11:
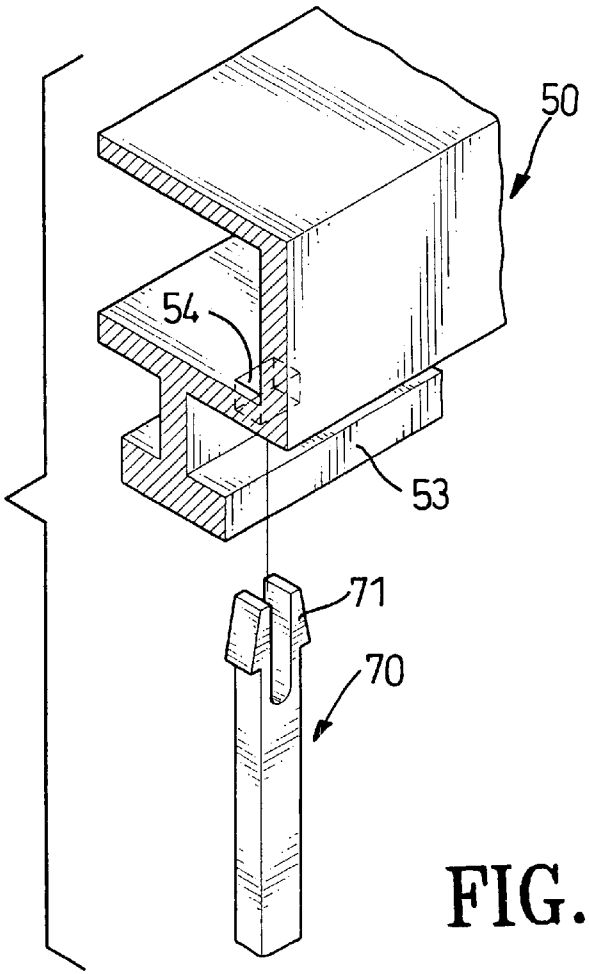
FIG. 11 is a partially enlarged exploded view of one embodiment of the fixing insertion and the insert hole of the tool suspension rack.

With reference to FIG. 11, an embodiment of resilient hook (70) is shown wherein the resilient hook (70) has a forked head (71) to wedge into the insert hole (54) of the suspension frame (50).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tool suspension rack adapted to receive at least one tool socket and comprising:

a suspension frame adapted to receive the at least one tool socket thereon and having:

a recess defined in the suspension frame;

a track formed laterally on an inner wall of the recess;

at least one socket connector corresponding to the at least one tool socket and mounting and sliding on the track, wherein the at least one socket connector has the through hole defined therein and detachably connecting with the at least one tool socket; and a fixing strip secured on the suspension frame and having:

multiple first insertions formed from the fixing strip, wherein each first insertion has a resilient hook formed on a distal end thereof and connects with the suspension frame by inserting the resilient hook into the through hole of the at least one socket connector; and multiple second insertions formed from the fixing strip, wherein each second insertion is shorter than the first insertion and formed on the fixing strip in an alternating manner with the first insertion;

wherein the second insertions fix and insert into the correspondingly at least one tool socket when the tool suspension rack is combined.

2. The tool suspension rack as claimed in claim 1, wherein the suspension frame further has at least one insert hole defined therein; and the fixing strip further has at least one fixing insertion protruding from the fixing strip, each fixing insertion has a resilient hook formed at a distal end thereof to wedge into the corresponding insert hole so as to combine the fixing strip to the suspension frame.

3. The tool suspension rack as claimed in claim 2, wherein the resilient hook has a forked head.

4. The tool suspension rack as claimed in claim 3, wherein the suspension frame further has a suspension hole defined therein.

* * * * *